US007551079B2

(12) United States Patent
Ortelle

(10) Patent No.: US 7,551,079 B2
(45) Date of Patent: Jun. 23, 2009

(54) JEWELRY SECURITY DEVICE

(76) Inventor: Lory Ortelle, 1784 Pine Ave., Petaluma, CA (US) 94954

( * ) Notice: Subject to any disclaimer, the term of this patent is extended or adjusted under 35 U.S.C. 154(b) by 102 days.

(21) Appl. No.: 11/422,257

(22) Filed: Jun. 5, 2006

(65) Prior Publication Data

US 2006/0273916 A1 Dec. 7, 2006

Related U.S. Application Data

(60) Provisional application No. 60/687,239, filed on Jun. 3, 2005.

(51) Int. Cl.
*G08B 1/08* (2006.01)

(52) U.S. Cl. ..... 340/539.13; 340/539.11; 340/573.4; 340/7.5; 340/574

(58) Field of Classification Search ..... 340/574, 340/7.5, 539.13, 539.11, 539.15, 321, 573.1, 340/573.4

See application file for complete search history.

(56) References Cited

U.S. PATENT DOCUMENTS

| | | | | | |
|---|---|---|---|---|---|
| 4,547,778 | A | * | 10/1985 | Hinkle et al. | 342/456 |
| 5,088,624 | A | | 2/1992 | Hackett et al. | |
| 5,345,221 | A | | 9/1994 | Pons et al. | |
| 5,358,144 | A | | 10/1994 | Mock | |
| 5,420,570 | A | | 5/1995 | Leitten et al. | |
| 5,429,301 | A | | 7/1995 | Franks | |
| 5,516,005 | A | | 5/1996 | Moseley | |
| 5,617,074 | A | * | 4/1997 | White | 340/573.4 |
| 5,652,570 | A | * | 7/1997 | Lepkofker | 340/573.4 |
| 5,729,203 | A | * | 3/1998 | Oka et al. | 340/573.1 |
| 5,988,450 | A | | 11/1999 | Cassarino | |
| 5,992,715 | A | | 11/1999 | Habibi | |
| 6,043,748 | A | * | 3/2000 | Touchton et al. | 340/573.3 |
| 6,278,370 | B1 | * | 8/2001 | Underwood | 340/573.1 |
| 6,310,539 | B1 | * | 10/2001 | Rye et al. | 340/321 |
| 6,540,107 | B1 | | 4/2003 | Admony | |
| 6,644,513 | B1 | | 11/2003 | Nesbitt | |
| 6,687,916 | B2 | | 2/2004 | Thompson | |
| 6,738,712 | B1 | | 5/2004 | Hildebrant | |
| 7,353,034 | B2 | * | 4/2008 | Haney | 455/457 |

* cited by examiner

*Primary Examiner*—Anh V La
(74) *Attorney, Agent, or Firm*—Advantia Law Group; Michael W. Starkweather; Jason P. Webb

(57) ABSTRACT

A distress signal system for protecting a person. There is an aesthetic piece; an activation module coupled to the aesthetic piece, wherein the activation module emits an activation signal when exposed to a triggering phenomenon; a notification module in communication with the activation module, wherein the notification module produces an electromagnetic notification signal upon receiving the activation signal, the notification module including: a global positioning module; a cellular telephone; and a microphone in communication with the notification module, wherein the electromagnetic notification signal comprises real-time audio information from the microphone.

16 Claims, 5 Drawing Sheets

JEWELRY SECURITY DEVICE

This invention claims priority, under 35 U.S.C. § 120, to the U.S. Provisional Patent Application No. 60/687,239 by Lory Ortelle filed on Jun. 3, 2005, which is incorporated by reference herein.

BACKGROUND OF THE INVENTION

1. Field of the Invention

The present invention relates to portable signal systems, specifically disguised portable signal systems.

2. Description of the Related Art

Individuals are often the subject of attack. As attacks by thieves, who may attack for unknown reasons or to attain a piece of property from the victim, have continued devices continue to be available for protecting the victim and/or his property. The reasons to deter or stop possible attacks are apparent. The devices typically use either or both offensive and defensive means for deterring the attacker and avoiding the attack.

In one class of art, the offensive means for avoiding attacks has been to employ a chemical deterrent such as pepper spray. Devices containing such chemicals have been used to direct the chemical to the thief However, devices containing spray chemicals are typically noticeable, and often the potential victim forgets to keep the device on his person. Further, activation of the device may require finding the device on the person, aiming the device, and activating the device. In the tense moments of an attack, the gracelessness of these activation steps may permit the attacker to complete his attack, or prevent the victim from activating the device. Thus, for the victims who either forget to have the device on his person, or fail to activate the device during an attack, the device is useless. Another disadvantage of offensive devices is that the device may either accidentally activated by the potential victim, resulting in possible harm to the potential victim. A further disadvantage to the offensive devices is that the possibility of the device being taken by the attacker and used against the victim.

Defensive devices include those that provide an audible alarm, Defensive devices lack the disadvantages of harming the potential victim and being difficult to aim and activate. One advantage to the audible alarm is that it alerts third persons to the situation and the general location of the attacker and victim. Defensive devices that provide an audible alarm have certain disadvantages. The first is that an attacker may not be deterred by the alarm, and continue to attack the victim. An attacker may also disable the alarm, resulting in a failure to alert passers-by and, therefore, failure of the third persons to learn the general location of the attacker and victim.

At times, the potential victim may not want to have the device on his person because it does not create the correct impression. When a potential victim carries the device on his person, he may appear to be fearful of potential thieves, and intentionally leave the device behind. This may be the case for either an offensive or a defensive means for deterring attacks.

U.S. Pat. No. 5,258,746 addresses the concern of the appearance of the means for deterring attacks. This patent discloses a portable high-intensity sonic alarm that is disguised as a piece of jewelry, or a wristwatch, or other item that is worn or easily carried by the victim. However, the only means for deterring the attack disclosed is a sonic alarm.

U.S. Pat. No. 5,429,301 also addresses the concern of the appearance of the means for deterring attacks. This patent discloses a personal protection device having the size, configuration and appearance in simulation of a telephone pager, but has the capability of emitting a chemical spray.

What is needed is a portable signal system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been filly solved by currently available portable signal systems. Accordingly, the present invention has been developed to provide a disguised portable signal system.

In one embodiment, there is a distress signal system for protecting a person. The system may include: an aesthetic piece, an activation module coupled to the aesthetic piece, wherein the activation module emits an activation signal when exposed to a triggering phenomenon; and/or a notification module in communication with the activation module, wherein the notification module produces an electromagnetic notification signal upon receiving the activation signal.

The notification module may produce an audible notification signal upon receiving the activation signal. The notification module may include a global positioning module and/or a cellular telephone.

The electromagnetic notification signal may include global positioning information, personal identification information, a call to 911 and/or real-time audio information.

The triggering phenomenon may be a voice command and/or an out of boundary signal from the global positioning module.

There may also be a microphone that may be in communication with the notification module.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1A:
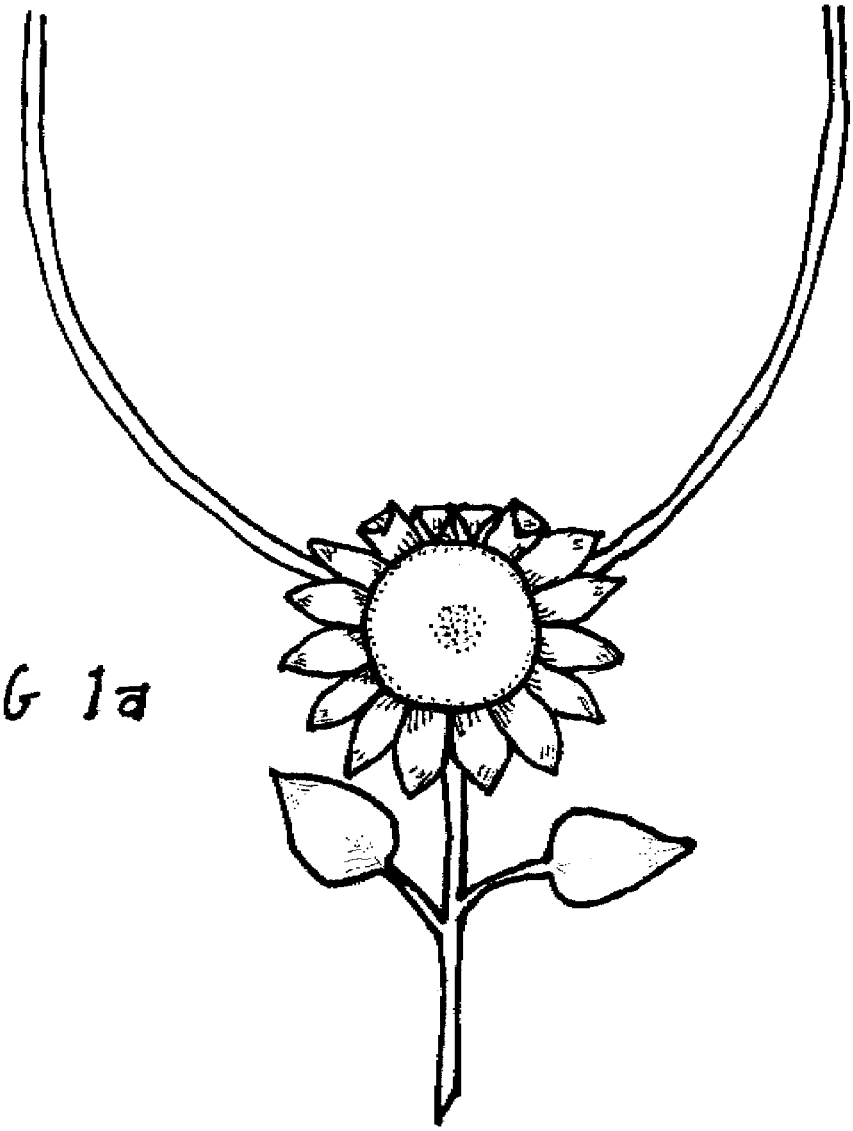
FIG. 1*a* illustrates a piece of jewelry that houses a notification device according to one embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "phenomenon" means an observable fact or event.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Figure 1B:
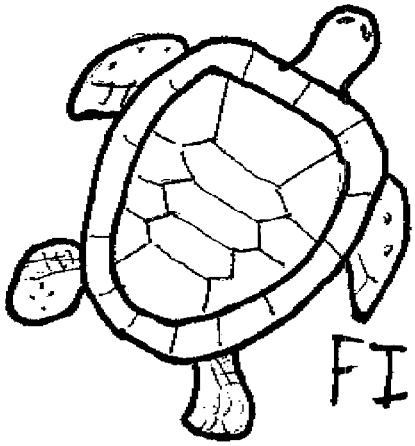
FIG. 1*b* illustrates an aesthetic piece that houses a notification device according to one embodiment of the invention.
Figure 1C:
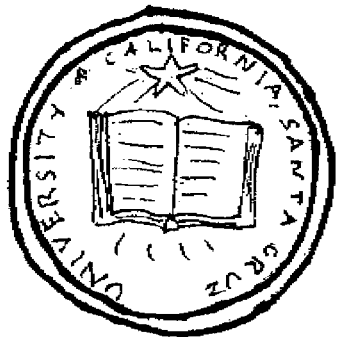
FIG. 1*c* illustrates an aesthetic piece that houses a notification device according to one embodiment of the invention.

Looking to the figures, various embodiments of a distress signal system combines a notification device or module 10, configured to notify of an attack, with an aesthetic piece, configured to be worn, carried, or had on the person of the potential victim. FIGS. 1*a*, 1*b* and 1*c* illustrate various aesthetic pieces that house or conceal the notification device 10 of the present invention.

In one embodiment, the aesthetic piece is a piece of jewelry, as seen in FIG. 1*a*. Pieces of jewelry are known, and can include any piece of jewelry that can be worn or carried by the potential victim. Non-limiting examples of pieces of jewelry that may be used in this embodiment include pendants, bracelets, key chain fobs, zipper pull fobs, lapel pins, collegiate pins, sports team pins, accent pins, etc.

In another embodiment, the aesthetic piece is an accent piece, as seen in FIGS. 1*b* and 1*c*. An accent piece can include any accent piece that can be worn or carried by the potential victim. Non-limiting examples of accent pieces that can be worn or carried by the potential victim include purses, suitcases, briefcases, camping gear, fishing gear, hunting gear, cameras, electronic equipment, camera bags, electronic equipment bags, etc.

The aesthetic piece serves the purpose of being attached to the notification device, and any item that the potential victim keeps on his person, for example by wearing or carrying, may serve as the aesthetic piece.

The notification device includes an alarm that is configured to emit an audible signal such as but not limited to a loud, piercing shrill when it is activated. The shrill is loud enough to attract the attention of passers-by when it is activated. Devices that are capable of emitting a loud piercing shrill are known in the art. U.S. Pat. Nos. 5,258,746 and 5,420,570, hereby incorporated by reference, describe such an alarm that is of a size that can be placed on a wristwatch.

The notification device 10 includes a power source 14, an activation unit or module 12, an alarm 15, and a control circuit 16. The notification device may also contain devices that track the position of the distress signal system, such as a global positioning system 13, devices that contact emergency personnel, such as a "911" module 11, devices that signal a global positioning system 43, such as a global positioning system contacting module 18, devices that send signals to a cellular phone 41, such as a "911" contacting module 17, and devices that facilitate transmission of audible data from the location of the distress signal system. The distress signal system allows for the communication between two, more, or all of these devices such that information from each device may be shared with the other devices. As an example, the location of the distress signal device, as tracked by the global positioning system 13, 43, may be shared with the "911" module 11, the cellular phone 41, or even "911" emergency personnel that may be contacted. Such sharing of information between the devices may facilitate alleviation of the distress signaled by the victim by notifying others, such as passers-by and emergency personnel.

Non-limiting examples of Global Positioning Devices include: Garmin StreetPilot C330 GPS Receiver; Garmin nuvi 350 GPS Receiver; Lowrance iWAY 500C GPS Receiver; Garmin eTrex Legend GPS Receiver; Garmin Forerunner 305 GPS Receiver; and Garmin GPSMAP 60CSx GPS Receiver.

A control unit or module may include a computer which may include one or more of the following: a CPU, motherboard, bus, ROM memory, and RAM memory. Vendors of such include IBM, Dell, VIA, Intel, and AMD. Further, many cell phones include control units and may be programmable.

Figure 2:
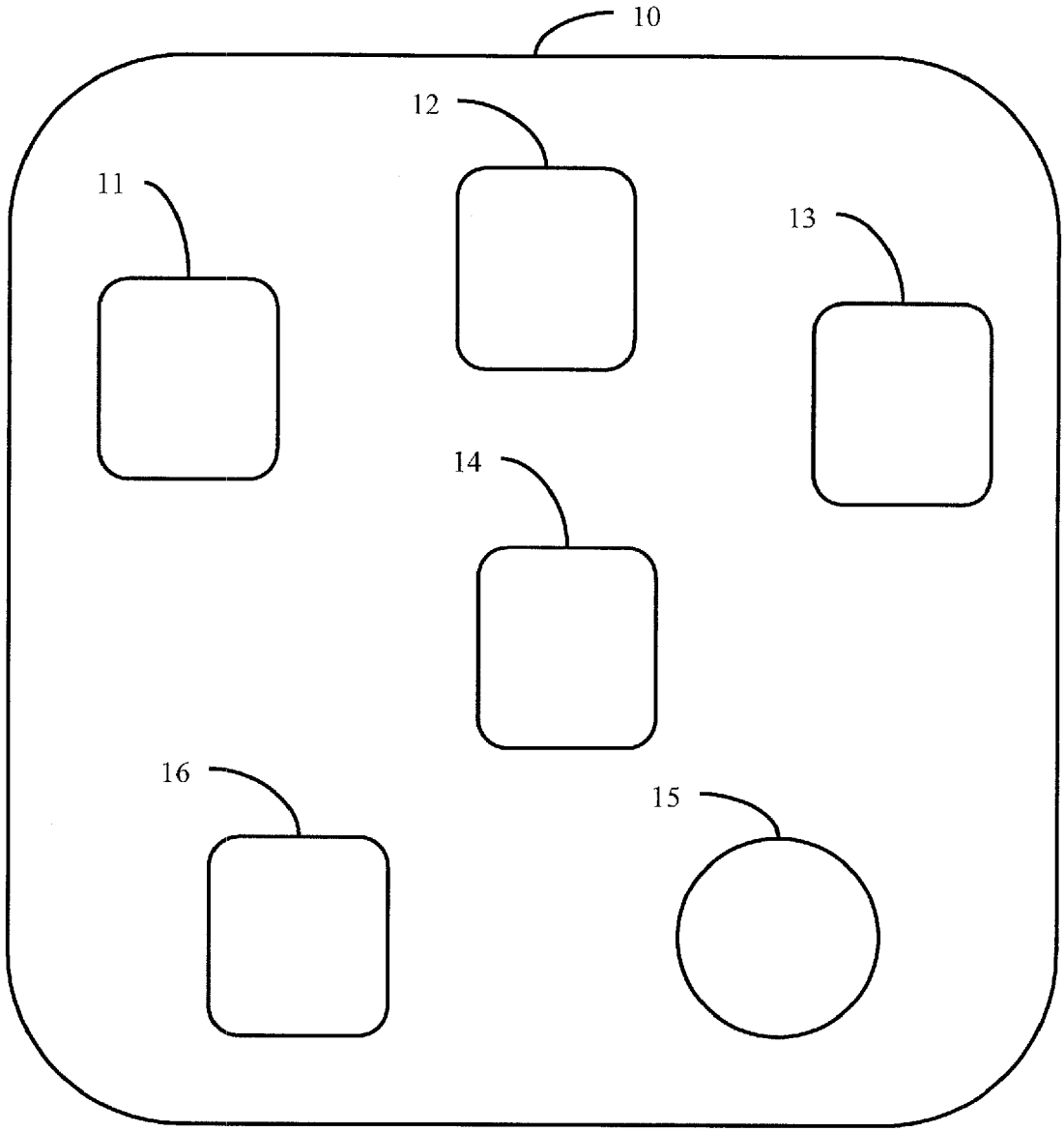
FIG. 2 illustrates a notification device according to one embodiment of the invention.
Figure 3:
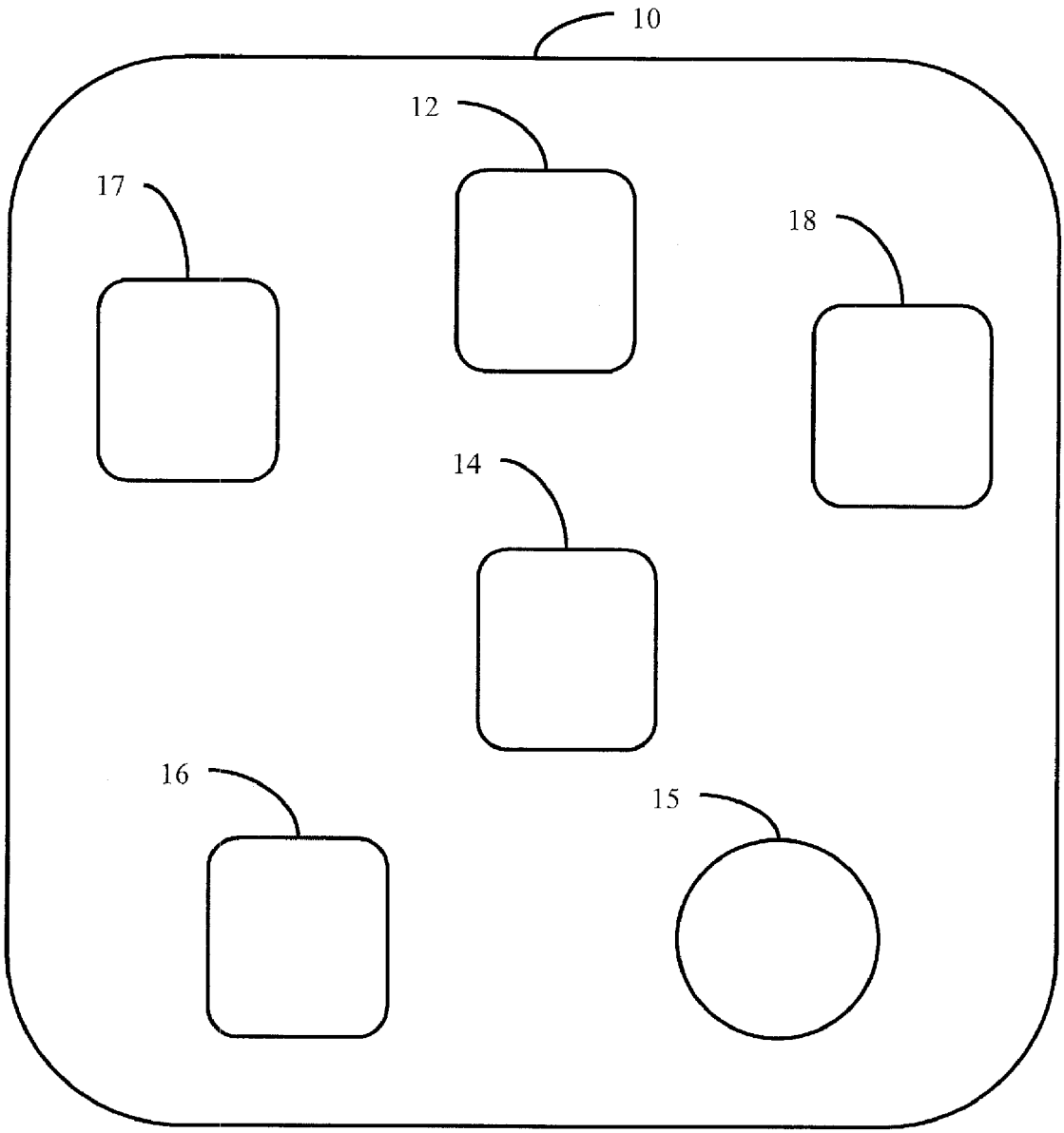
FIG. 3 illustrates a notification device according to one embodiment of the invention.
Figure 4:
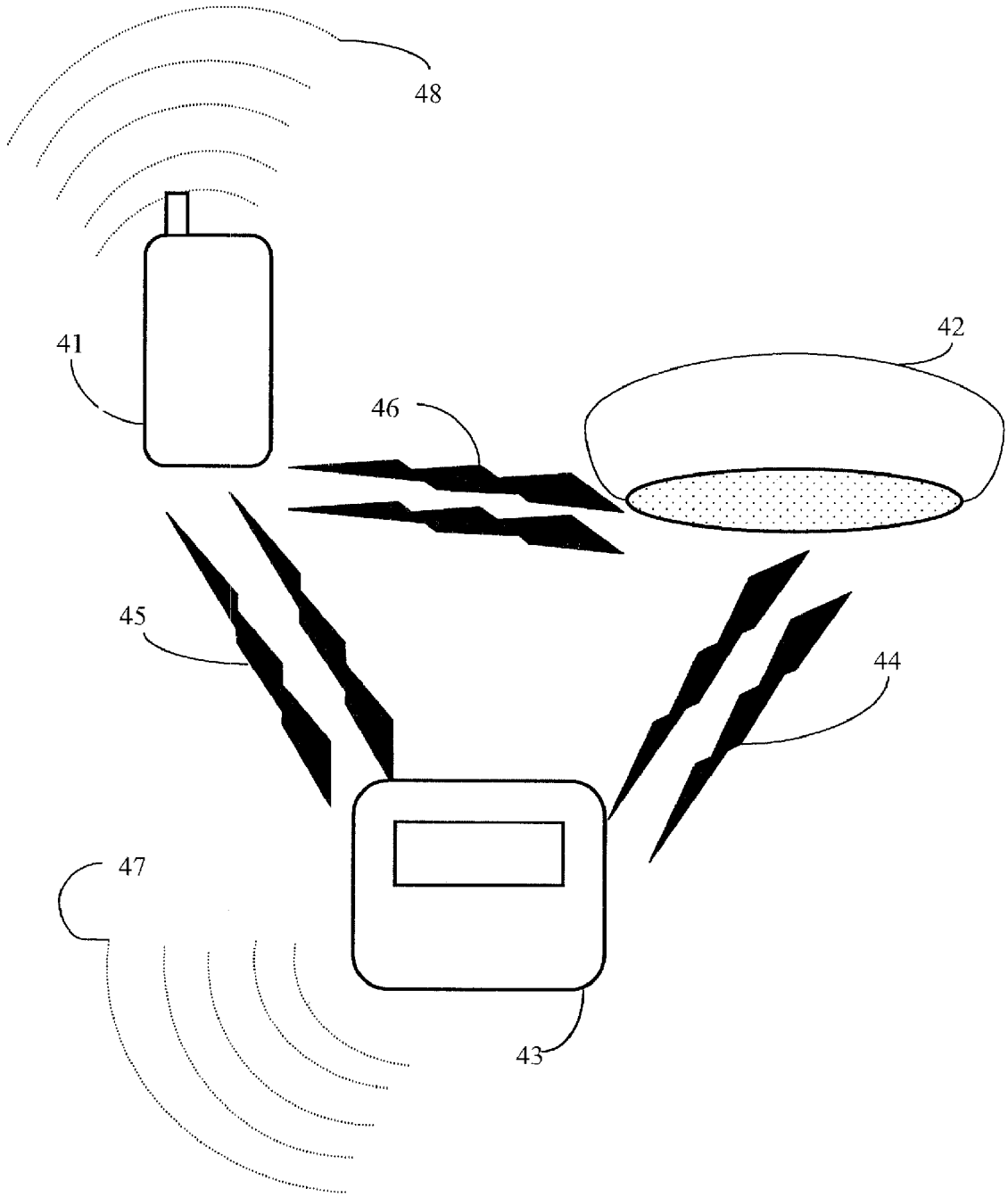
FIG. 4 illustrates an embodiment of the distress signal system in conjunction with other optional components according to one embodiment of the invention.
Figure 5:
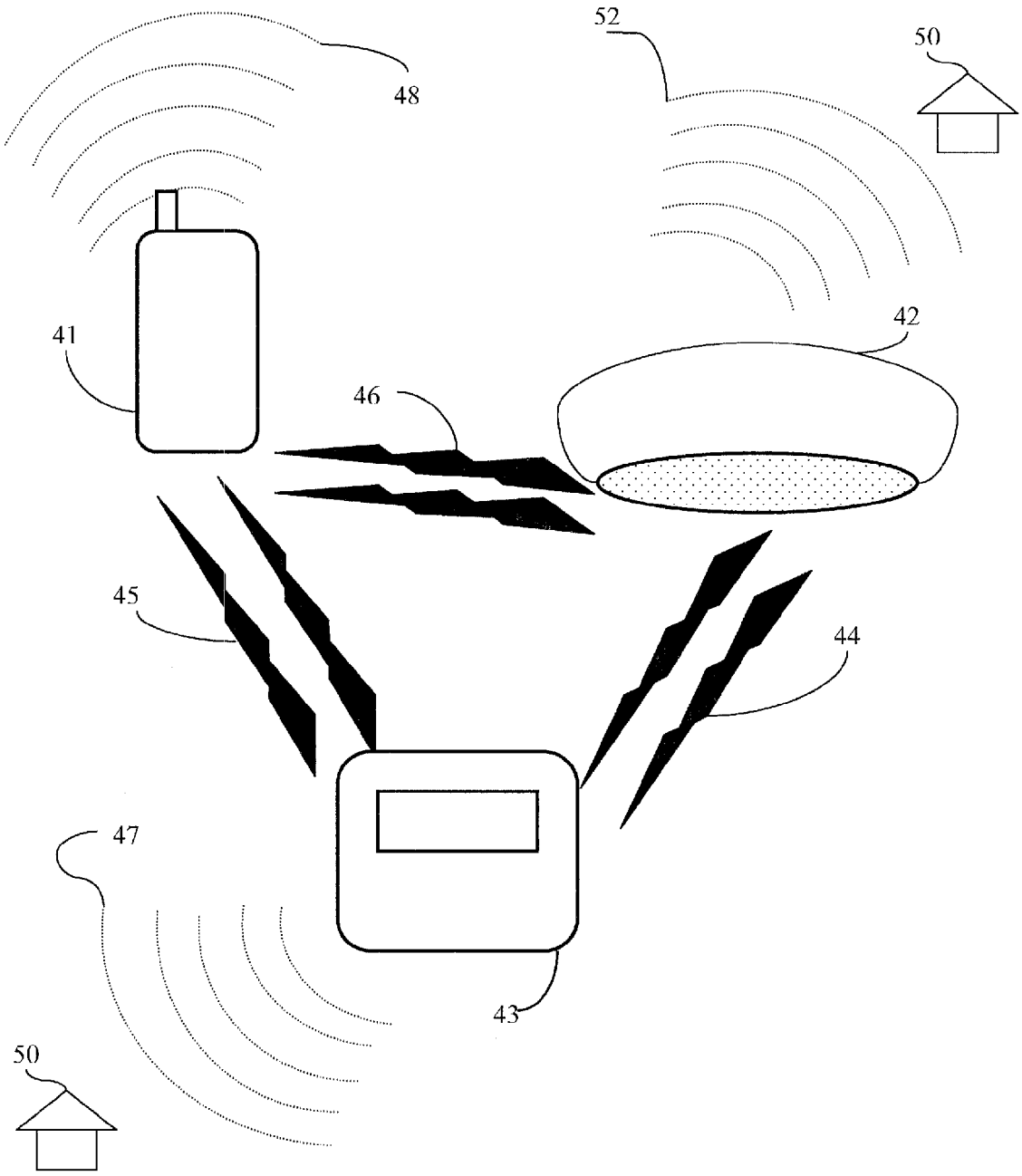
FIG. 5 illustrates an embodiment of the distress signal system in conjunction with other optional components according to one embodiment of the invention.

In one embodiment, illustrated in FIG. 2 the notification device also includes a "911" contacting module 17 that sends a signal 46 to the potential victim's cellular phone 41 to contact emergency personal via a "911" telephone call 48.

The power source 14 may be any power source known in the art that is capable of supplying sufficient power to the notification device 10. In one embodiment the power source includes a battery.

In one embodiment, the notification device 10 includes a "911" module 11 that contacts emergency personnel directly via a "911" telephone call. In another embodiment, the notification device 10 includes a "911" module 11 and a microphone that may facilitate audio transmissions from the notification device 10. A cellular telephone microphone may be used.

Non-limiting examples of cellular telephones include: Motorola T300p Push to Talk Phone; Motorola V710 Bluetooth Phone; Samsung P777 Phone, RIM Blackberry 700g; Samsung P735 Video Phone; Motorola i836 Phone; Motorola V65p Push to Talk Phone; and Sony Ericsson P990.

In another embodiment, the notification device 10 on the distress signal system 42 includes a global positioning system contacting module 18 that sends a signal 44 to a global positioning system device 43, which sends a signal 47 of the location of the global positioning system. In this embodiment, the global positioning system device 43 may be any that is known in the art. Non-limiting examples of the global positioning system device include global positioning systems that are components of a cellular phone, detached global positioning systems, global positioning systems that are components of a personal data assistant, etc. In one embodiment, the global positioning system 43 is not a component of a cellular phone 41, and the signal 45 sent from the global positioning system 43 is sent to the cellular phone 41.

In another embodiment, the notification device 10 includes a global positioning system 13. In this embodiment, the global positioning system 13 may include tracking capabilities. In this embodiment, the global positioning system 13 may send a signal 46 to the potential victim's cellular phone 41. Also in this embodiment, the global positioning system 13 may send a signal to the "911" contact module 17.

In one embodiment the global positioning system 17, 43, whether separate from the notification device 10 or part of the notification device 10, is used in conjunction with the "911" module 11 or the potential victim's cellular phone 41 to transmit a signal 48 to emergency personnel via a "911" telephone call. In this embodiment, a signal may be transmitted from the global positioning system to the "911" module 11 or the potential victim's cellular phone 41. In another embodiment the global positioning system 17, 43 that is either separate from the notification device or part of the notification device is used to transmit a signal 47 without use of the "911" module 11 or the cellular telephone 41. In another embodiment, the global positioning system 17, 43 that is either separate from the notification device or part of the notification device may transmit signals both to any of "911" module 11 or the potential victim's cellular phone 41.

The signals 44, 46 between the notification device 10 on the distress signal system 42 and the various other devices mentioned (such as the global positioning device 43, the cellular phone 41 and the personal data assistant) may be by any means known in the art. One skilled in the art would appreciate that some non-limiting examples of signals between pieces of equipment include hard-wiring, infrared, and radio frequency including, for example, short-range radio frequency such as Bluetooth.

The activation unit 12 sends a signal to the control circuit 16 to activate the alarm 15 and the other components of the notification device 10. One skilled in the art would appreciate that various non-limiting examples of activation units 12 include pull-chains, switches, buttons, and pressure transducers, etc. In one embodiment the activation unit is triggered by an audible command, such as voice. In one embodiment, the activation unit 12 comprises a pressure transducer. The pressure transducer may function so as to signal the control circuit 16 when pressure is applied to the distress signal system 42. Alternatively, in this embodiment the pressure transducer may function so as to signal the control circuit 16 only when a predetermined amount of pressure is applied to the distress signal system 42, or when pressure is repeatedly applied to the distress signal system 42. Further, many cell phones are programmable and/or voice activated and may therefore in one embodiment of the invention be programmed to trigger a call to 911 or another emergency service and transmit one or more preprogrammed messages that may include personal indentification information such as but not limited to name, address, social security number, description of appearance. Real-time audio from the cell phone's microphone may also be transmitted through the call. More a signal, such as a voice and/or morse code may be sent corresponding to a current location indicated by a GPS receiver.

In another embodiment, the distress signal system contains, either physically or electronically, personal identification information about the potential victim. Non-limiting examples of such information include the potential victim's name, address, and medical information. The personal identification information, if contained electronically, may be displayed on any available display source to which the information is sent, once the activation unit has been triggered. In another embodiment, any component which is signaled by the notification device 10, such as the global positioning system 13, 43, or personal data assistant, or cellular phone 41, contains the personal identification information. The component containing the personal identification information may display the personal identification when so signaled to do by the notification device 10.

In another embodiment, the global positioning system 13, 43 contain information to a set zone outside of which the distress signal system may signal a third party 50, and/or trigger the activation unit 12. In this embodiment, for example, if a child or an institutionalized patient wearing the distress signal system were to pass outside of the set zone, a signal 47, 52 would be sent from the distress signal system to a third party 50, to, for example, notify the third party 50 that the child or patient has passed outside of the zone. In this embodiment, the signal 47, 52 could be sent by any component of the notification device capable of sending a signal. The signal 47, 52 could be received by, for example, an alarm with the third party, or the telephone of the third party, or any way of communicating to the third party 50 that the child or patient has passed outside of the set zone or is out of bounds. Further, signals 47, 50 could be sent as to the location of the child or patient from the distress signal system or the detached global positioning system 43. This embodiment is not meant to be limited to children or patients, and any means of communicating to the third party that the potential victim is no longer within the set zone is envisioned and within the scope of the claims.

It is understood that the above-described preferred embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claim rather than by the foregoing description. All changes which come within the meaning and range of equivalency of the claims are to be embraced within their scope.

For example, although only some types of signals between pieces of equipment are described, any means of signaling between the pieces of equipment known to one skilled in the art is embraced within the scope of the claims relating to signaling between pieces of equipment.

Additionally, it is foreseeable that certain of the devices in the embodiments of the present invention may be part of the same device. One example would be a personal data assistant that includes a global positioning system and a cellular phone. Such a device could serve as both the cellular phone and the global positioning system within the claims of this invention.

Further, the power source may be any power source known in the art that is capable of supplying sufficient power for the notification device. As technology improves, the power requirements for the components of the notification device may decrease to a point when smaller power supplies are needed. Further, as power technology improves, devices that are not batteries that supply sufficient power to the other components may become available. Such technology should be deemed within the scope of the claims of this invention.

Additionally, the activation units may be any that is capable of sending a signal to the control circuit. The signal sent may be by any means known to one skilled in the art, such as mechanical as with a switch, electrical as with a pressure transducer, radio frequency, infrared, etc.

Further, though only certain examples of how information is shared between the devices and components both part of and separate from the distress signal system, any signals between any of the components or devices mentioned in this disclosure is within the scope of the claims.

It is expected that there could be numerous variations of the design of this invention. An example is that the aesthetic piece need not be confined to the articles listed in this application. The aesthetic piece can be any item that is potentially worn, carried, or on the potential victim's person that serves the purpose of being connected to the notification device. One skilled in the art would appreciate that as technology improves, the elements of the notification device will require less space. As the elements require less space, the notification device will likewise require less space. As the notification devices require less and less space, the number of potential items that may serve as aesthetic pieces increases until even very small items that are not typically worn or carried by a person may serve as the aesthetic piece.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A distress signal system for protecting a person comprising:

an aesthetic piece, an activation module coupled to the aesthetic piece, wherein the activation module emits an activation signal when exposed to a triggering phenomenon; and a notification module in communication with the activation module, wherein the notification module produces an electromagnetic notification signal upon receiving the activation signal; wherein the notification module includes a global positioning module and wherein the electromagnetic notification signal includes global positioning information; wherein the triggering phenomenon is a voice command in communication with an out-of-boundary signal from the global positioning module.

2. The distress signal system of claim 1, wherein the notification module further comprises producing an audible notification signal upon receiving the activation signal.

3. The distress signal system of claim 1, wherein the notification module includes a cellular telephone.

4. The distress signal system of claim 3, wherein the electromagnetic notification signal comprises a telephone call to 911.

5. The distress signal system of claim 1, further comprising a microphone in communication with the notification module, wherein the electromagnetic notification signal comprises real-time audio information from the microphone.

6. The distress signal system of claim 1, wherein the electromagnetic notification signal includes personal identification information.

7. The distress signal system of claim 1, wherein the system allows for the communication between two (2), more, or all of the notification modules such that information from each notification module is shared with the other notification modules.

8. The distress signal system of claim 1, wherein the electromagnetic notification signal is Morse code, wherein the signal is configured to correspond a current location indicated by a global positioning module.

9. A distress signal system for protecting a person, consisting essentially of:

an aesthetic piece, an activation module coupled to the aesthetic piece, wherein the activation module emits an activation signal when exposed to a triggering phenomenon; wherein the triggering phenomenon is a voice command in communication with an out of boundary signal from a global positioning module;

a notification module in communication with the activation module, wherein the notification module produces an electromagnetic notification signal upon receiving the activation signal; and a microphone in communication with the notification module, wherein the electromagnetic notification signal comprises real-time audio information from the microphone.

10. The distress signal system of claim 9, wherein the notification module further comprises producing an audible notification signal upon receiving the activation signal.

11. The distress signal system of claim 10, wherein the notification module includes the global positioning module and wherein the electromagnetic notification signal includes global positioning information.

12. The distress signal system of claim 11, wherein the notification module includes a cellular telephone.

13. The distress signal system of claim 12, wherein the electromagnetic notification signal comprises a telephone call to 911.

14. The distress signal system of claim 13, wherein the electromagnetic notification signal includes personal identification information.

15. A distress signal system for protecting a person, comprising:

an aesthetic piece, an activation module coupled to the aesthetic piece, wherein the activation module emits an activation signal when exposed to a triggering phenomenon; wherein the triggering phenomenon is a voice command;

a notification module in communication with the activation module, wherein the notification module produces an electromagnetic notification signal upon receiving the activation signal, the notification module including:

a global positioning module; wherein the triggering phenomenon is the voice command in communication with an out-of-boundary signal from the global positioning module;

a cellular telephone; and a microphone in communication with the notification module, wherein the electromagnetic notification signal comprises real-time audio information from the microphone.

16. The distress signal system of claim 15, wherein the electromagnetic signal comprises a telephone call to 911, global positioning information, real-time audio information, and personal identification information.

* * * * *